US007429707B2

(12) United States Patent
Yanai et al.

(10) Patent No.: US 7,429,707 B2
(45) Date of Patent: Sep. 30, 2008

(54) PUSH SWITCH

(75) Inventors: Yasunori Yanai, Okayama (JP); Takashi Tomago, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/834,987

(22) Filed: Aug. 7, 2007

(65) Prior Publication Data

US 2008/0035462 A1 Feb. 14, 2008

(51) Int. Cl.
*H01H 5/18* (2006.01)

(52) U.S. Cl. ..... 200/1 B; 200/406; 200/516

(58) Field of Classification Search ..... 200/1 B, 200/406, 516
See application file for complete search history.

(56) References Cited

U.S. PATENT DOCUMENTS 5,898,147 A * 4/1999 Domzalski et al. ..... 200/1 B
6,639,159 B2 * 10/2003 Anzai ..... 200/1 B
6,936,777 B1 * 8/2005 Kawakubo ..... 200/1 B
6,995,324 B2 * 2/2006 Asada ..... 200/1 B
7,157,650 B2 * 1/2007 Rochon ..... 200/1 B
7,250,581 B2 * 7/2007 Asada ..... 200/341

FOREIGN PATENT DOCUMENTS

JP 2004-031171 1/2004

* cited by examiner

*Primary Examiner*—Michael A Friedhofer
(74) *Attorney, Agent, or Firm*—RatnerPrestia

(57) ABSTRACT

A push switch which includes a switch case, a first movable contact, and a second movable contact. The switch case has a central fixed contact on an inner bottom face of its recess that has an open top, and a peripheral fixed contact. The first movable contact is curved protruding upward, and has a hole at its center. The first movable contact is disposed over the peripheral fixed contact with a space in between. The second movable contact is curved protruding upward, and is placed on the first movable contact. A pressing force for resiliently inverting the second movable contact is set greater than a pressing force for resiliently inverting the first movable contact; and two tactile feedbacks are produced by pressing from a side of the second movable contact.

12 Claims, 9 Drawing Sheets

PUSH SWITCH

BACKGROUND OF THE INVENTION

1. Field of the Invention

The present invention relates to push switches employed as input units in a range of electronic devices, and more particularly to two-step push switches in which a first switch operates by a first push and a second switch operates by a further push.

2. Background Art

With electronic devices becoming increasingly smaller, components are also more densely packed inside. Push switches with two-step tactile feedback, which are employed in input units of these electronic devices, also need to become smaller and slimmer to save mounting space.

A conventional push switch with two-step tactile feedback is described next with reference to FIGS. 8 to 14.

FIG. 8 is an outline view of the conventional push switch. FIG. 9 is a sectional view taken along line 9-9 in FIG. 8, and FIG. 10 is a sectional view taken along line 10-10 in FIG. 8. FIG. 11 is a plan view of the conventional switch case. FIG. 12 is a sectional view taken along line 9-9 in FIG. 8, illustrating the operation of a first step. FIG. 13 is a sectional view taken along line 9-9 in FIG. 8, illustrating the operation of a second step. FIG. 14 is a chart of tactile curves for the conventional push switch.

In FIGS. 8 to 11, switch case 1 is made of insulating resin, and has recess 1A that has an open top. Switch case 1 also has movable contact housing recess 1B on the inner bottom center of this recess 1A. Central fixed contact 2 is disposed at the center of this movable contact housing recess 1B, and peripheral fixed contact 3 is disposed at two points symmetrical about central fixed contact 2. Outer fixed contact 4 is disposed at two points symmetrical about central fixed contact 2, outside movable contact housing recess 1B.

Central fixed contact 2 is electrically connected to third connecting terminal 5, and peripheral fixed contacts 3 are electrically connected to second connecting terminal 6. Outer fixed contacts 4 are electrically connected to first connecting terminals 7.

Dome-shaped second movable contact 8 is disposed on movable contact housing recess 1B at the inner bottom center of recess 1A of this switch case 1. The bottom edge of the outer periphery of this second movable contact 8 contacts peripheral fixed contacts 3. The center of this second movable contact 8 faces central fixed contact 2.

First movable contact 9 includes ring portion 9A, narrow central portion 9B at the center which is bridged to ring portion 9A by a coupling bar dividing the space inside ring portion 9A into two parts, and peripheral portion 9C provided on an outer periphery of ring portion 9A at opposing positions. A draw piece expanding upward is provided along the circumference at equal intervals of 90°. This first movable contact 9 is disposed on outer fixed contact 4 by its peripheral portion 9C. In this state, central portion 9B is positioned over second movable contact 8 at a predetermined distance. Projection 9D extending downward is provided at the center of central portion 9B.

Vertically movable operating member 10 is disposed on the top face of central portion 9B of first movable contact 9.

In addition, cover 11 is attached to switch case 1 so as to cover the top face of recess 1A. Operating area 10A of operating member 10 protrudes upward from central hole 11A in cover 11.

The conventional push switch as described above is configured such that second movable contact 8 and first movable contact 9 are housed inside recess 1A of switch case 1, and operating member 10 is provided over this structure.

When operating area 10A of operating member 10 is pressed in the conventional push switch as configured above, the coupling bar, connecting central portion 9B to ring portion 9A in first movable contact 9 underneath, inverts and ring portion 9A resiliently deforms. This produces first-step tactile feedback. Projection 9D on the bottom face of central portion 9B then contacts the top center of second movable contact underneath. This establishes an electrical connection between first connecting terminal 7 and second connecting terminal 6 via first movable contact 9 and second movable contact 8.

When operating area 10A of operating member 10 is further pressed, projection 9D on central portion 9B of first movable contact 9 presses the top center of second movable contact 8. When this pressing force exceeds a predetermined level, a second-step tactile feedback is produced by the resilient inversion of a dome portion of second movable contact 8. The bottom center of second movable contact 8 then contacts central fixed contact 2. This establishes an electrical connection among first connecting terminal 7, second connecting terminal 6, and third connecting terminal 5.

When the pressing force on operating area 10A of operating member 10 is released, the dome portion of second movable contact 8, which has resiliently inverted, reverts by itself, providing tactile feedback. Accordingly, the top center of this dome portion pushes back projection 9D on central portion 9B upward, and thus its bottom face separates from central fixed contact 2. Third connecting terminal 5 therefore becomes electrically independent from first connecting terminal 7 and second connecting terminal 6.

Ring portion 9A of first movable contact 9 and the coupling bar connecting ring portion 9A to central portion 9B then reverts by itself, providing tactile feedback. This makes projection 9D of central portion 9B separate from the top face of second movable contact 8. First connecting terminal 7 and second connecting terminal 6 thus also become electrically independent. Accordingly, the push switch returns to its original state without any pressing force, as shown in FIGS. 8 to 10.

One prior art related to the present invention is disclosed in Japanese Patent Unexamined Publication No. 2004-031171.

In this conventional push switch, the first-step tactile feedback is produced when central portion 9B of first movable contact 9 is pressed by a pressing force, and the draw piece of ring portion 9A is resiliently deformed. Then, the second-step tactile feedback is produced when projection 9D on central portion 9B of first movable contact 9 presses the center of second movable contact 8 by further pressing central portion 9B, and second movable contact 8 is resiliently deformed.

These operational changes are described using a chart of tactile curves in FIG. 14 in which a pressing load is plotted along the vertical axis and the distance is plotted along the horizontal axis.

Tactile curve 14 in FIG. 14 shows the operational changes of independent first movable contact 9. In this tactile curve 14, a difference between maximal value 14A of the operation force and a minimal value 14B of the operation force produces tactile feedback. If this difference is large relative to the pressing load at maximal value 14A, the user feels strong tactile feedback. The distance between these points affects the crispness of the feedback. When the distance between maximal value 14A and minimal value 14B is long, tactile feedback is produced slowly. This first movable contact 9 is designed to allow further resilient deformation because it needs to press second movable contact 8 after passing minimal value 14B, where the first-step tactile feedback is produced.

Next, operational changes of independent second movable contact 8 are shown in tactile curve 15 in FIG. 14. The dome portion of second movable contact 8 resiliently inverts and produces the tactile feedback between maximal value 15A and minimal value 15B. Then, second movable contact 8 does not move further and only the pressing load increases because the dome center on the bottom face of this second movable contact 8 touches central fixed contact 2 after the dome portion is resiliently inverted.

The tactile curve of the conventional push switch is achievable by combining tactile curves 14 and 15 in FIG. 14. This is indicated as tactile curve 16.

In tactile curve 16, the tactile curve for first movable contact 9, which is the first step, changes in the same way as tactile curve 14, but then first movable contact 9 is further deformed while second movable contact 8 is deformed after the first-step tactile feedback is produced. This means the two movable contacts are pressed simultaneously.

In other words, at maximal value 16C and minimal value 16D in FIG. 14, which is the second-step tactile feedback, the pressing load of first movable contact 9 corresponding to its operating position (distance) is applied in addition to the pressing load of second movable contact 8 in the tactile curve. This makes it complicated to achieve the intended pressing load. In particular, the load for further deforming first movable contact 9 after passing its minimal value 14B increases in a quadratic curve. Accordingly, the pressing load of minimal value 16D in this tactile curve 16 further increases, and the difference between maximal value 16C and minimal value 16D shrinks, resulting in dull tactile feedback for the second step.

SUMMARY OF THE INVENTION

The push switch of the present invention includes a switch case, a first movable contact, and a second movable contact. The switch case is made of insulating resin, and has a central fixed contact and peripheral fixed contacts. The central fixed contact is disposed on an inner bottom center of a recess that has an open top. The peripheral fixed contacts are disposed at points symmetrical about this central fixed contact. Multiple first grooves are created on an inner side wall of the recess. The first movable contact is made of a thin resilient metal plate whose top part is curved to form a dome protruding upward. A ring portion with a central hole of the first movable contact is disposed over the peripheral fixed contacts with a space in between. The first movable contact has multiple legs extending from the outer rim of the ring portion at positions corresponding to the first grooves. The second movable contact is made of a thin resilient metal plate whose top part is curved to form a dome protruding upward. This second movable contact is placed on the ring portion of the first movable contact. Here, a pressing force for resiliently inverting the second movable contact is set greater than a pressing force for resiliently inverting the first movable contact; and two tactile feedbacks are produced by pressing from a side of the second movable contact.

By means of this structure, the present invention offers a small and thin push switch with comfortable first-step and second-step tactile feedback, without causing an detrimental effect that may be caused by resilient deformation of the first movable contact on the tactile feedback produced by resilient deformation of the second movable contact.

DETAILED DESCRIPTION OF THE INVENTION

A preferred embodiment of the present invention is described with reference to drawings.

Figure 1:
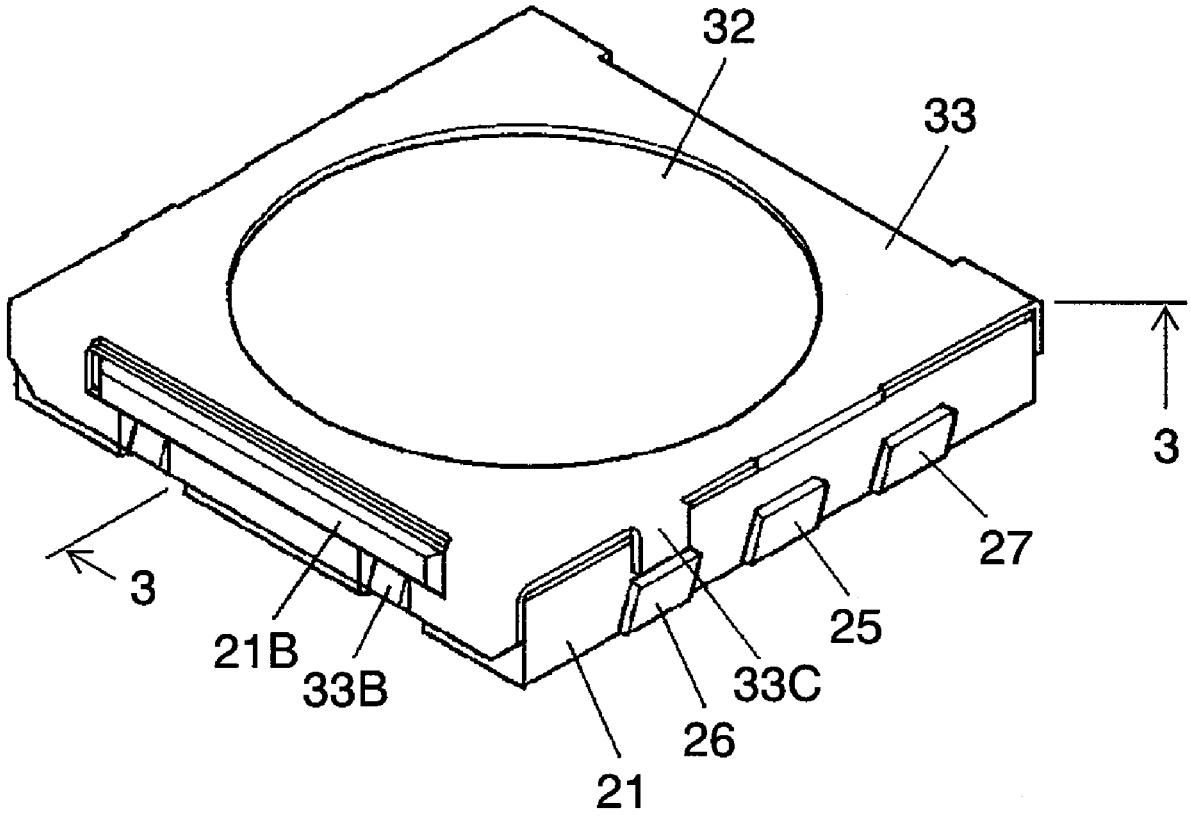
FIG. 1 is an outline view of a push switch in accordance with a preferred embodiment of the present invention.
Figure 2:
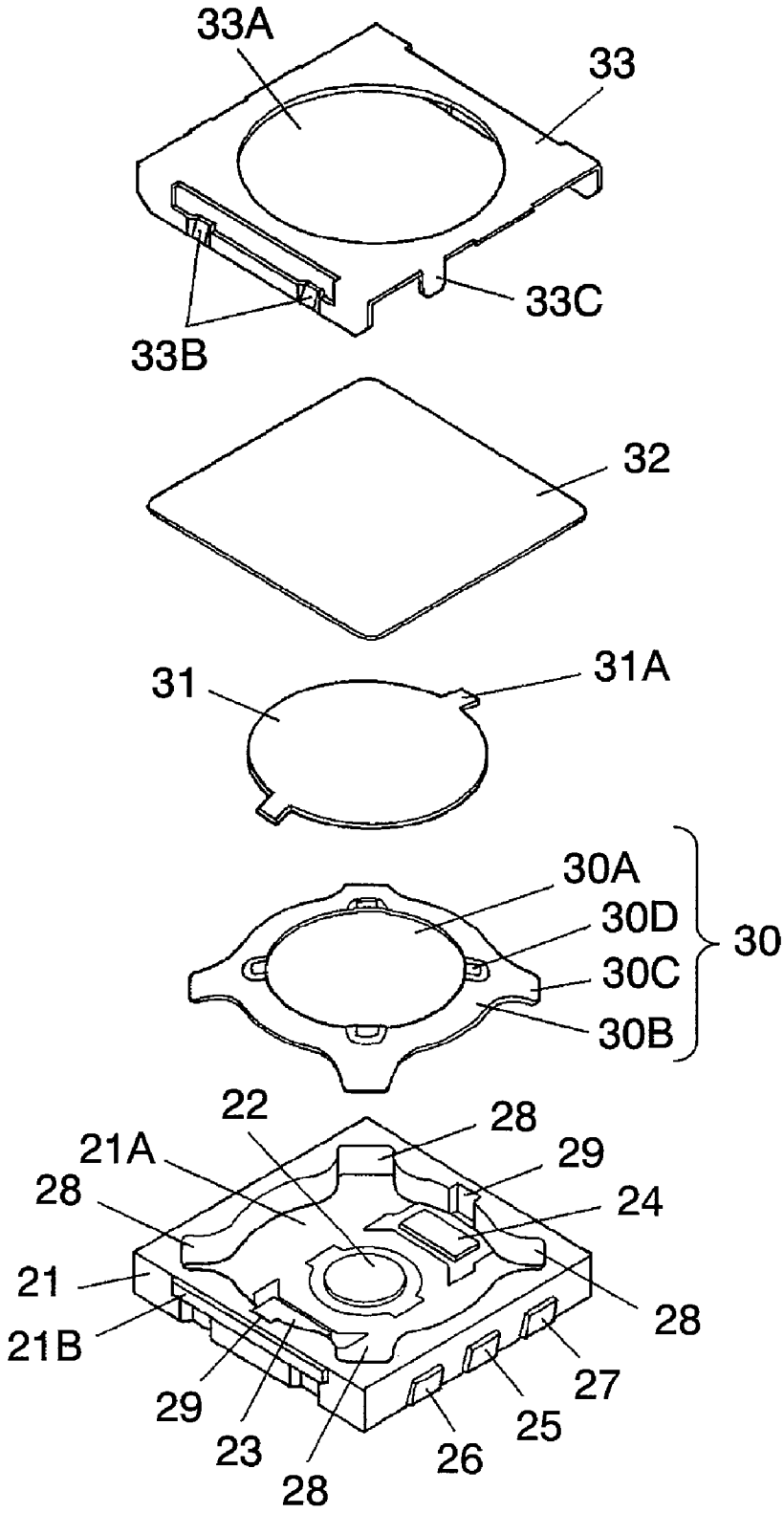
FIG. 2 is an exploded perspective view of the push switch in accordance with the preferred embodiment of the present invention.
Figure 3:
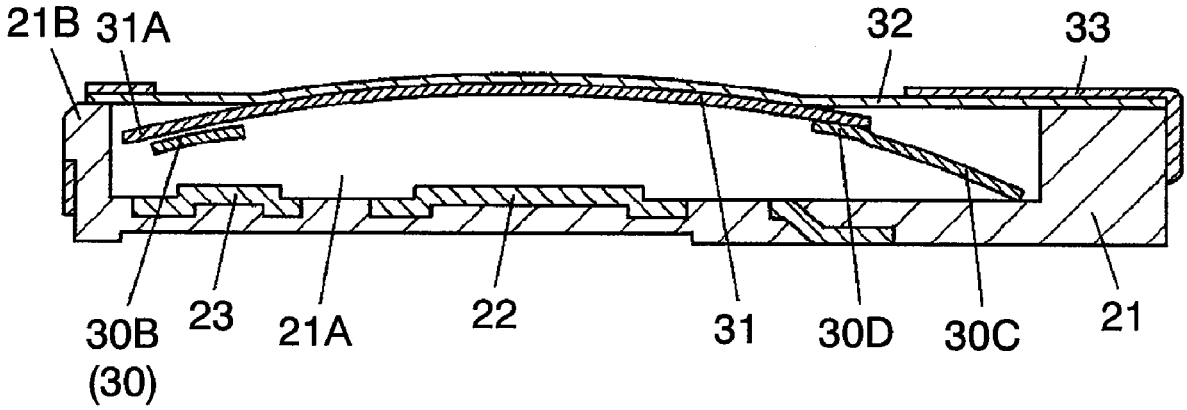
FIG. 3 is a sectional view taken along line 3-3 in FIG. 1.
Figure 4:
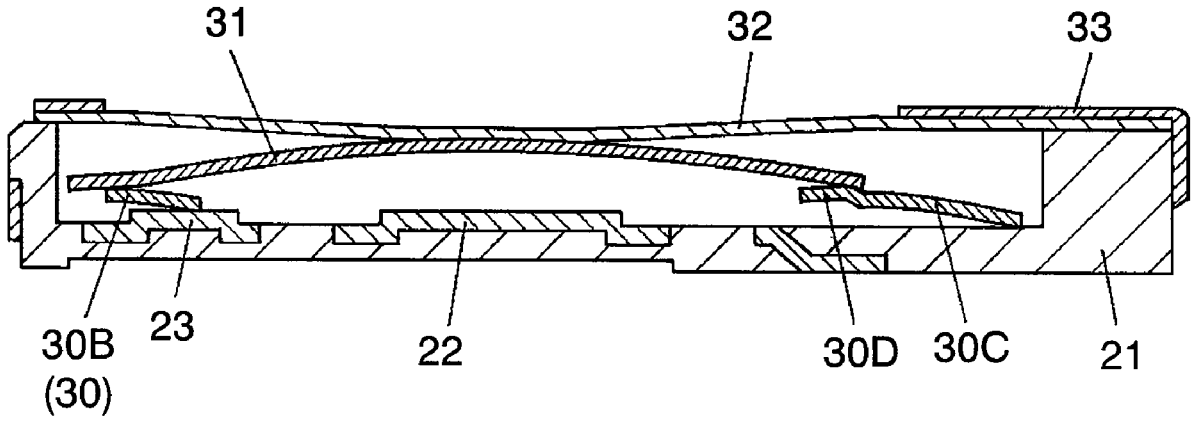
FIG. 4 is a sectional view taken along line 3-3 in FIG. 1, illustrating a first-step operation.
Figure 5:
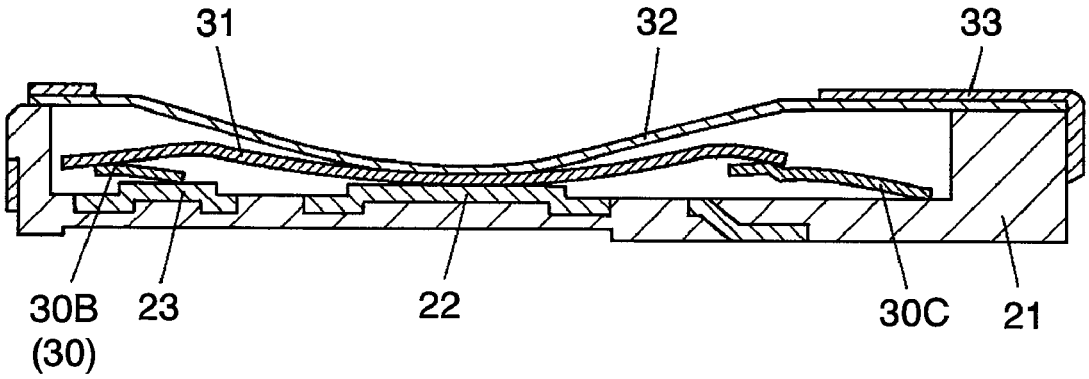
FIG. 5 is a sectional view taken along line 3-3 in FIG. 1, illustrating a second-step operation.
Figure 6:
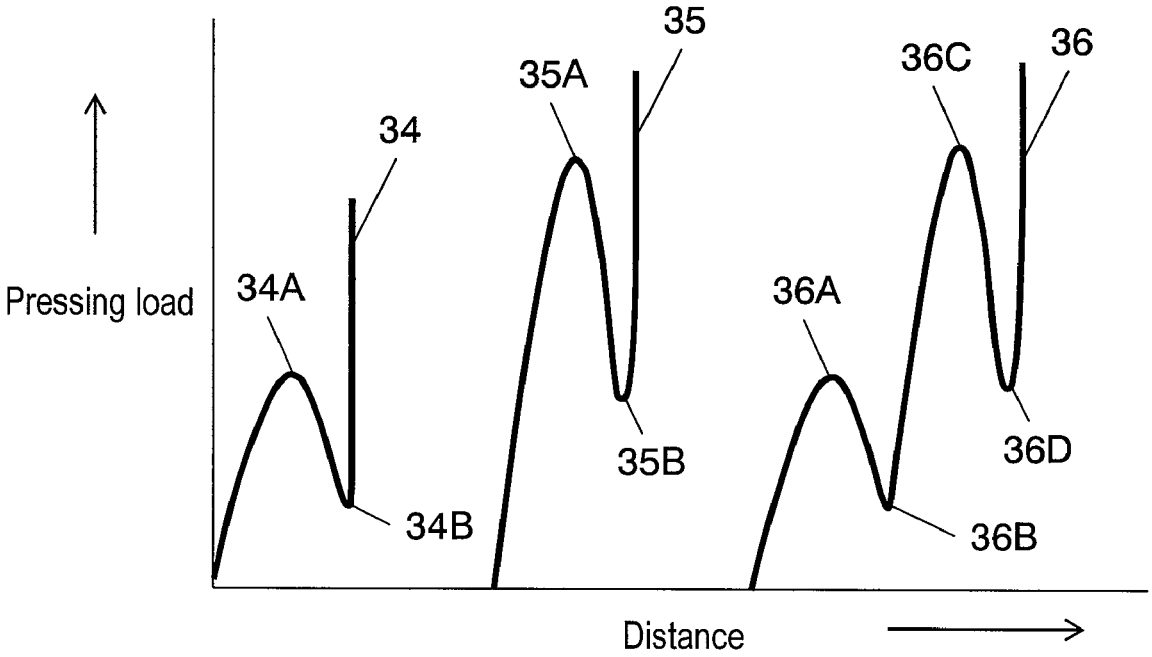
FIG. 6 is a chart of tactile curves of the push switch in accordance with the preferred embodiment of the present invention.

FIG. 1 is an outline view of a push switch in the preferred embodiment of the present invention. FIG. 2 is an exploded perspective view, and FIG. 3 is a sectional view taken along line 3-3 in FIG. 1. FIG. 4 is a sectional view taken along line 3-3 in FIG. 1, illustrating a first-step operation. FIG. 5 is a sectional view taken along line 3-3 in FIG. 1, illustrating a second-step operation. FIG. 6 is a chart of tactile curves.

In FIGS. 1 to 3, square switch case 21 made of insulating resin has substantially round recess 21A that has an open top. On an inner bottom face of this recess 21A, central fixed contact 22 is disposed at the center and independent peripheral fixed contacts 23 and 24 are disposed at two points symmetrical about central fixed contact 22. Second connecting terminal 25 electrically connected to central fixed contact 22 and first connecting terminals 26 and 27 electrically connected to peripheral fixed contacts 23 and 24, respectively, are led outside in an electrically independent manner. At positions corresponding to four corners of this square switch case 21, four first grooves 28 are created in the vertical direction on inner walls of substantially round recess 21A, respectively. In addition, two second grooves are created in the vertical direction on inner walls in the same straight lines corresponding to two peripheral fixed contacts 23 and 24. Aforementioned first connecting terminals 26 and 27 and second connecting terminal 25 are led out from opposing side walls of switch case 21, respectively. Second connecting terminal 25 is led out at the center of each side wall, and two first connecting terminals 26 and 27 are led out at both sides of second connecting terminal 25, at equal spaces.

If above first connecting terminals 26 and 27, and second connecting terminal 25 are led out only from one side of square switch case 21, a switch mounting area on a wiring board (not illustrated) can be reduced, contributing to saving the space.

First movable contact 30 made of a thin resilient metal plate has ring portion 30B with central hole 30A, and four legs 30C extending obliquely downward from a periphery of ring portion 30B at equiangular positions on the same circumference, forming a curved dome portion protruding upward.

This first movable contact 30 is housed inside recess 21A of switch case 21 such that its legs 30C are fitted inside four first grooves 28, respectively. In this state, the bottom face of ring portion 30B faces peripheral fixed contacts 23 and 24 at a predetermined distance. The width of each leg 30C of first movable contact 30 is set slightly narrower than that of first grooves 28 so that first movable contact 30 is positioned by placement of its legs 30C.

A bending height of first movable contact 30, achieved by a dome portion protruding upward, can be adjusted by changing a dimension of these four legs 30C in the obliquely downward direction. This achieves various operating distances for the first step.

In addition, first movable contact 30 has four projections 30D protruding upward on an inner rim of ring portion 30B at equiangular positions on the same circumference. These projections 30D are disposed at the angular positions in the same directions as the positions of legs 30C.

This first movable contact 30 resiliently inverts its dome portion downward, providing tactile feedback, when ring portion 30B is pressed to an extent exceeding a predetermined pressing force.

Substantially round second movable contact 31 is made of a thin resilient metal plate which has a dome portion curved protruding upward. An outer rim on its bottom face contacts and rests on four projections 30D of first movable contact 30. This second movable contact 31 has protruding member 31A, with a predetermined width, extending from the outer rim at two 180° opposing points. These protruding members 31A are fitted into two second grooves 29, respectively, provided on the inner side wall of recess 21A of switch case 21. These protruding members 31A provided at two points have a predetermined width slightly narrower than that of second grooves 29, and they are provided to guide vertical movement of second movable contact 31 when pressed.

This second movable contact 31 resiliently inverts its dome portion, providing a tactile feed back, when its center is pressed to an extent exceeding a predetermined pressing force. The dome portion is curved such that the pressing force required for its resilient inversion becomes greater than the pressing force required for resilient inversion of first movable contact 30. In the reverse sequence, when pressing force applied is reduced in the resiliently-inverted state, the dome portion is curved such that a pressing force for its self-reversion of second movable contact 31 becomes also greater than the pressing force for self-reversion of first movable contact 30.

Protection sheet 32 is made of a flexible insulating resin film, and has an adhesive layer on its bottom face. This protection sheet 32 adheres to and holds the top face of dome portion of second movable contact 31 by its adhesive layer. Protection sheet 32 also adheres to and fixes on switch case 21 such that to cover the top face of recess 21A of switch case 21. Cover 33 made of a thin metal plate is attached to switch case 21 such that this protection sheet 32 exposes from its round hole 33A at the center.

Edges of this cover 33 are bent downward, respectively, so that bent edges face two side walls of switch case 21 perpendicular to a side wall where connecting terminals 25, 26 and 27 of switch case 21 are led out. Hooking claws 33B provided at ends of bent edges are hooked and fixed onto lower ends of hooking protrusions 21B provided on outer side walls of switch case 21.

Also on this cover 33, narrow grounding protrusion 33C is formed by obliquely bending downward to an edge position corresponding to the position were first connecting terminal 26 is led out. A tip of this grounding protrusion 33C is in contact with first connecting terminal 26.

This grounding protrusion 33C leads static electricity flowing in, when an electrostatically-charged operator operates the push switch, to a grounding circuit of a wiring board (not illustrated) soldered to first connecting terminal 26 via grounding protrusion 33C of this cover 33. Accordingly, this grounding protrusion 33C is provided with an aim of preventing failure of electronic circuits of an appliance due to static electricity. This structure eliminates the need of plating of cover 33 for soldering, and also eliminates the need of providing another terminal or member for grounding. Alternately, grounding protrusion 33C may be provided at a position such that its tip contacts first connecting terminal 27 on the other side.

Next, the operation of the push switch as configured above is described with reference to FIGS. 4 and 5.

When the dome center of second movable contact 31 is pressed from above via protection sheet 32, as shown in FIG. 4, the outer rim of the bottom face of second movable contact 31, which rests on projection 30D of first movable contact 30, presses projection 30D. The dome portion of first movable contact 30 resiliently inverts, accompanied by tactile feedback, when the pressing force exceeds a predetermined level. This makes the bottom face of ring portion 30B of first movable contact 30 contact peripheral fixed contacts 23 and 24, and in turn, electrically connect first connecting terminals 26 and 27. The tactile feedback experienced during resilient inversion of the dome portion of this first movable contact 30 is the first-step tactile feedback.

Since four projections 30D on ring portion 30B of first movable contact 30 are provided at angular positions in the same directions as the positions of the four legs 30C, legs 30C support the pressing force applied. Projections 30D close to legs 30C act efficiently as a force to resiliently invert domed ring portion 30B, providing comfortable tactile feedback.

In addition, since four legs 30C extending from the outer rim of ring portion 30B of first movable contact 30 are provided at equiangular positions on the same circumference, the pressing force applied from the second movable contact 31 to ring portion 30B can be supported evenly in good balance. This enables stable operation feedback that generates a clear click during resilient inversion.

When the dome center of second movable contact 31 is further pressed, as shown in FIG. 5, first movable contact 30 does not deform further because the bottom face of ring portion 30B which experiences the pressing force is already in contact with peripheral contacts 23 and 24. Next, when the pressing force applied to second movable contact 31 exceeds a predetermined level, the dome portion of second movable contact 31 resiliently inverts, accompanied by tactile feedback. The bottom face of this dome center then contacts central fixed contact 22 underneath central hole 30A of first movable contact 30. At this point, first movable contact 30 maintains an electrical connection with peripheral fixed contacts 23 and 24. First connecting terminals 26 and 27 and second connecting terminal 25 are electrically connected by second movable contact 31 touching central fixed contact 22.

This tactile feedback experienced during resilient inversion of second movable contact 31 is the second-step tactile feedback.

As described above in the structure of the present invention, the pressing force for resiliently inverting the dome portion of second movable contact 31 by pressing is set greater than the pressing force for resiliently inverting the dome portion of first movable contact 30. This enables the generation of first-step tactile feedback by resilient inversion of first movable contact 30, and the generation of second-step tactile feedback by resilient inversion of second movable contact 31.

When the pressing force is released via protection sheet 32, second movable contact 31 reverts first, accompanied by tactile feedback, to its original dome shape protruding upward. Accordingly, second movable contact 31 separates from central fixed contact 22, and thus second connecting terminal 25 is electrically isolated from first connecting terminals 26 and 27, as shown in FIG. 4.

Then, first movable contact 30 reverts by itself, accompanied by tactile feedback, to its original dome shape. Accordingly, the bottom face of ring portion 30B separates from peripheral fixed contacts 23 and 24, and thus first connecting terminals 26 and 27 are electrically isolated. The push switch returns to its normal state, shown in FIG. 3, without any pressing force being applied.

Also on release of this pressing force, the pressing force for self-reversion of the dome portion of second movable contact 31 is set to be greater than the pressing force for self-reversion of the dome portion of first movable contact 30. Second movable contact 31 thus reverts first, followed by first movable contact 30. The order in which the electrical connections between connecting terminals are broken on releasing the pressing force is thus the exact opposite of the order in which they are made during pressing. This prevents any sense of discomfort and facilitates the circuit design of appliances in which the push switch will be employed.

Throughout the resilient inversion and reversion of the first step and second step, protrusions 31A provided at two opposing points on the outer rim of second movable contact 31 are guided by two second grooves 29 provided on the inner side walls of recess 21A of switch case 21. This limits any horizontal deviation during vertical movement, producing stable and comfortable tactile feedback.

Since four legs 30C extending from the outer rim of ring 30B of first movable contact 30 are provided at equiangular positions on the same circumference, the pressing force is evenly supported by these legs. This produces a stable tactile feel. Still more, the width of four legs 30C is set slightly narrower than the width of first grooves 28 created in the inner side wall of recess 21A of switch case 21. Accordingly, rotational deviation of first movable contact 30 when vertically pressing the push switch can also be prevented. This also contributes to gaining a stable and comfortable operation feel.

Restriction of deviation of both first movable contact 30 and second movable contact 31 also suppresses mutual deviation of the two movable contacts, gaining a stable and comfortable operation feedback.

Next, operational changes are described with reference to a chart of tactile curves shown FIG. 6. Pressing load is dotted along the vertical axis, and the distance is plotted along the horizontal axis.

When the push switch is pressed, a change related to exceeding first maximum value 36A to minimal value 36B occurs, as shown in tactile curve 36 in FIG. 6. This change represents the first-step tactile feedback produced by resilient inversion of first movable contact 30 in the above description of operation. From this state, when the push switch is further pressed, a change related to exceeding second maximum value 36C to minimal value 36C occurs. In the same way, this change represents the second-step tactile feedback produced by resilient inversion of second movable contact 31 in the above description of operation.

Here, the maximal value is the maximum pressing load applied at the moment of resilient inversion of the dome portion of the movable contact. The minimal value is the minimal pressing load at the moment of self-reversion of the resiliently-inverted dome portion to its original state.

Next, the operational change is compared with that of independent movable contacts. Tactile curve 34 in FIG. 6 shows the operational change of independent first movable contact 30. The pressing load and distance between maximal value 34A and minimal value 34B generated by resilient inversion of the dome portion by the pressing force are same as initial maximal value 36A and minimal value 36B in tactile curve 36. After passing minimal value 36B, the pressing load rises suddenly in little distance. This indicates that first movable contact 30 does not move further even the pressing load is applied because first movable contact 30 is already in contact with opposing peripheral fixed contacts 23 and 24 underneath when first movable contact 30 has resiliently inverted.

Tactile curve 35 show the operational change of independent second movable contact 31. The pressing load of maximal value 35A and minimal value 35B generated by resilient inversion of the dome portion by pressing is same as maximal value 36C and minimal value 36D of tactile curve 36 of the push switch.

As described above, in the push switch of the present invention, the operational change of first movable contact 30 does not affect the operation of second movable contact 31 which is the second-step tactile feedback. With respect to maximal value 36C, ring portion 30B contacts peripheral fixed contacts 23 and 24 after resilient inversion of first movable contact 30, and thus first movable contact 30 does not deform further. This results in not affecting the pressing load of second movable contact 31. In other words, the pressing load is directly acting on second movable contact 31, achieving the same value as maximal value 35A for independent second movable contact 31.

With respect to minimal value 36D, the outer rim of the bottom face of second movable contact 31 is placed on ring portion 30B of movable contact 30. Accordingly, the load at self-reversion of first movable contact 30 is applied only to the outer rim of second movable contact 31, and thus no force is applied to push back the resiliently inverted dome portion. Minimal value 36D thus becomes the same value as minimal value 35B for independent movable contact 31.

In the present invention, the load for resilient inversion and self-reversion of first movable contact 30 does not affect the load for resilient inversion and self-reversion of second movable contact 31. This achieves the push switch with comfortable tactile feedback for both first step and second step.

Still more, the pressing load at maximal value 35A of second movable contact 31 is set greater than the pressing load at maximal value 34A of first movable contact 30. Accordingly, when the push switch is pressed, the dome portion of first movable contact 30 resiliently inverts first, and then the dome portion of second movable contact 31 resiliently inverts, establishing electrical connection between connecting terminals, providing respective tactile feedback for the first step and second step.

Still more, the pressing load at minimal value 35B of second movable contact 31 is set greater than the pressing load of minimal value 34B of first movable contact 30. This makes the dome portions of second movable contact 31 and first movable contact 30 self-revert in a sequence opposite to that in the pressing operation. Accordingly, electrical connections are disconnected in the sequence of second connecting terminal 25, and first connecting terminals 26 and 27. This prevents a sense of discomfort in operation, and also facilitates circuit design of an appliance in which the push switch will be employed.

Still more, projections 30D are disposed at equiangular positions on the same circumference of the top face of the ring portion of first movable contact 30, and second movable contact 31 is disposed on these projections 30D. These projections 30D thus support second movable contact 31, and their positions do not change, contributing to stable tactile feedback of second movable contact 31.

Still more, as shown in FIGS. 2 and 3, projections 30D of first movable contact 30 are disposed on the inner rim of ring portion 30B. This allows pushing of first movable contact 30 at a position closest to a virtual top of the dome portion of first movable contact 30. This offers a comfortable operation feedback for the first step.

In the above description, projections 30D are provided at four points on ring portion 30B of first movable contact 30, and second movable contact 31 is placed on these protrusions. However, the same effect is achievable with the structure shown in an exploded perspective view in FIG. 7.

Figure 7:
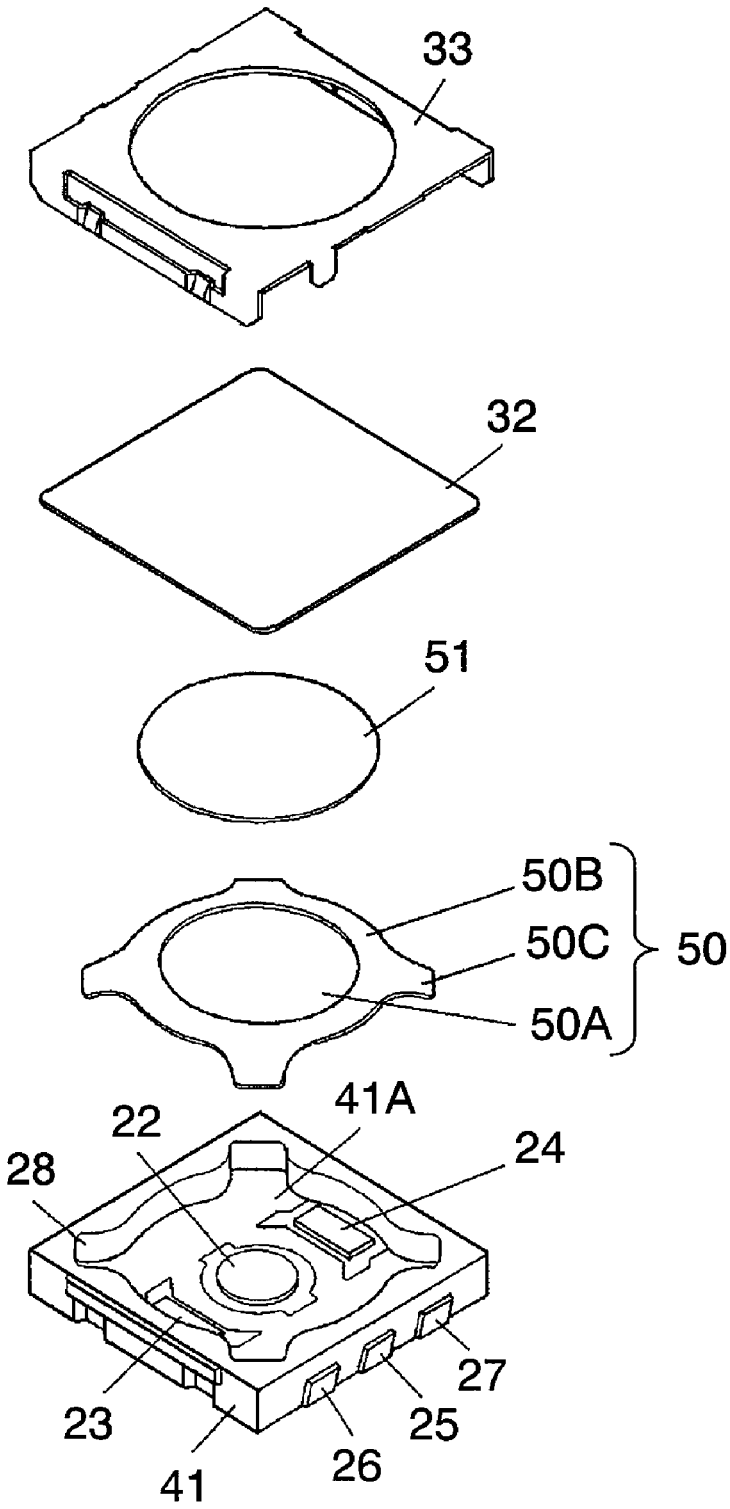
FIG. 7 is an exploded perspective view illustrating another structure for a first movable contact and a second movable contact of the push switch in accordance with the preferred embodiment of the present invention.
Figure 8:
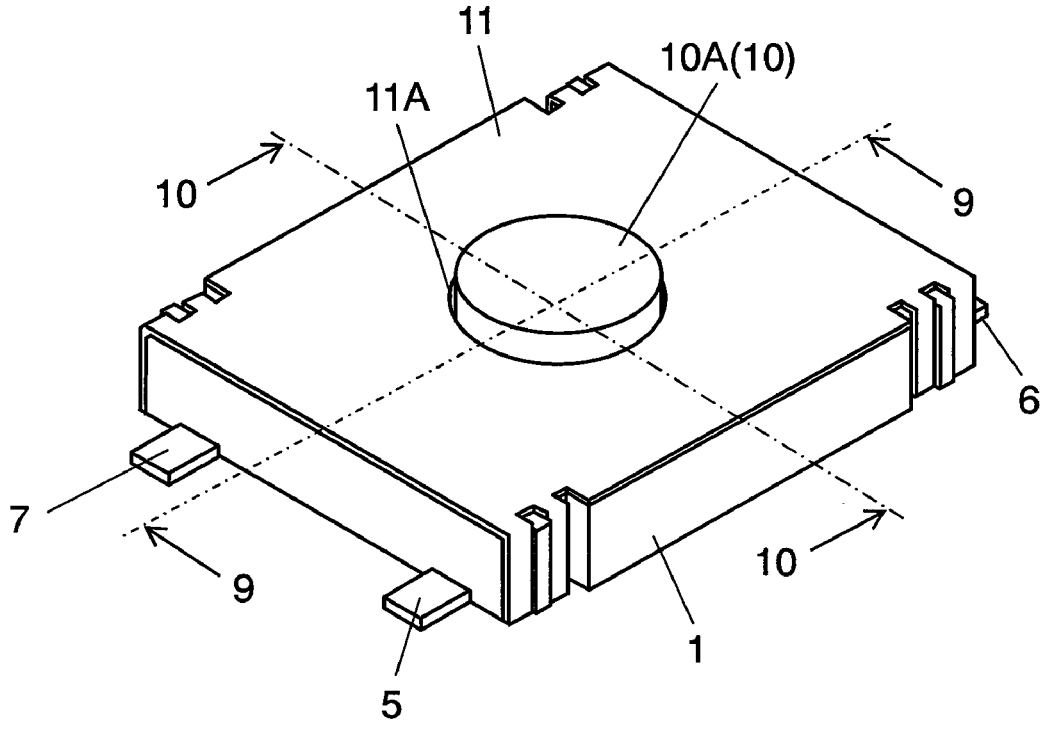
FIG. 8 PRIOR ART
FIG. 8 is an outline view of a conventional push switch.
Figure 9:
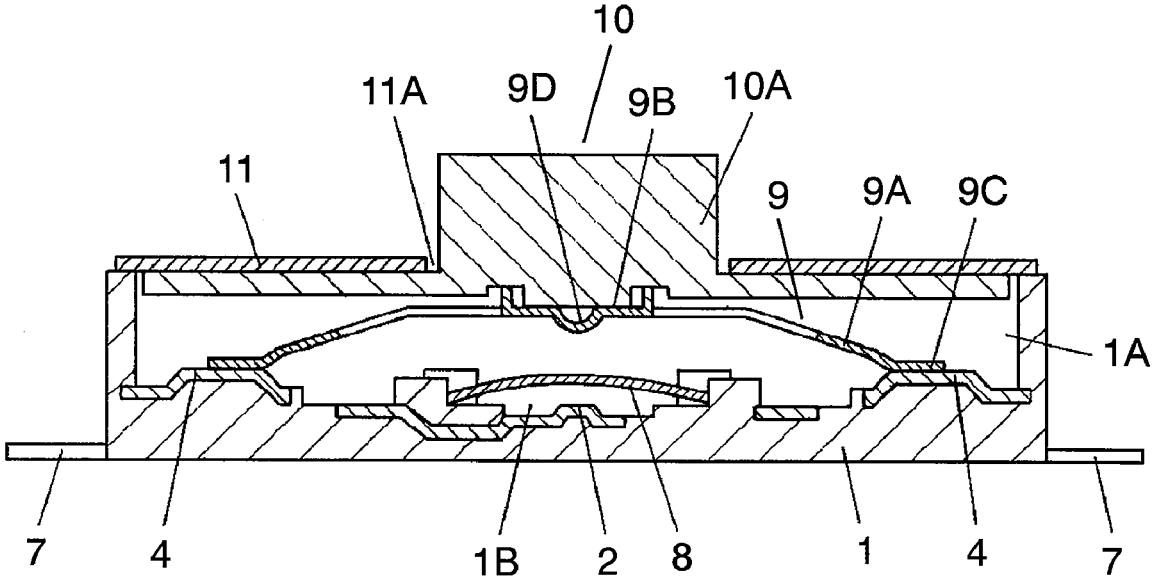
FIG. 9 PRIOR ART
FIG. 9 is a sectional view taken along line 9-9 in FIG. 8.
Figure 10:
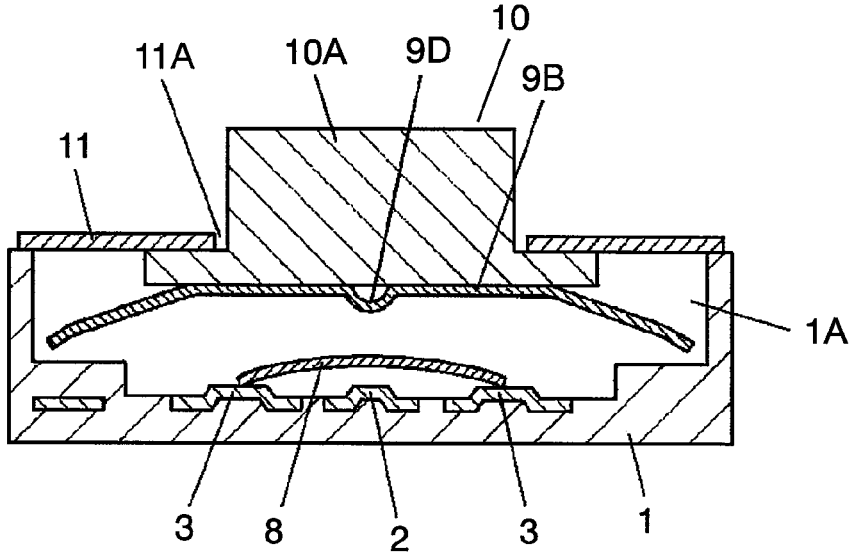
FIG. 10 PRIOR ART
FIG. 10 is a sectional view taken along line 10-10 in FIG. 8.
Figure 11:
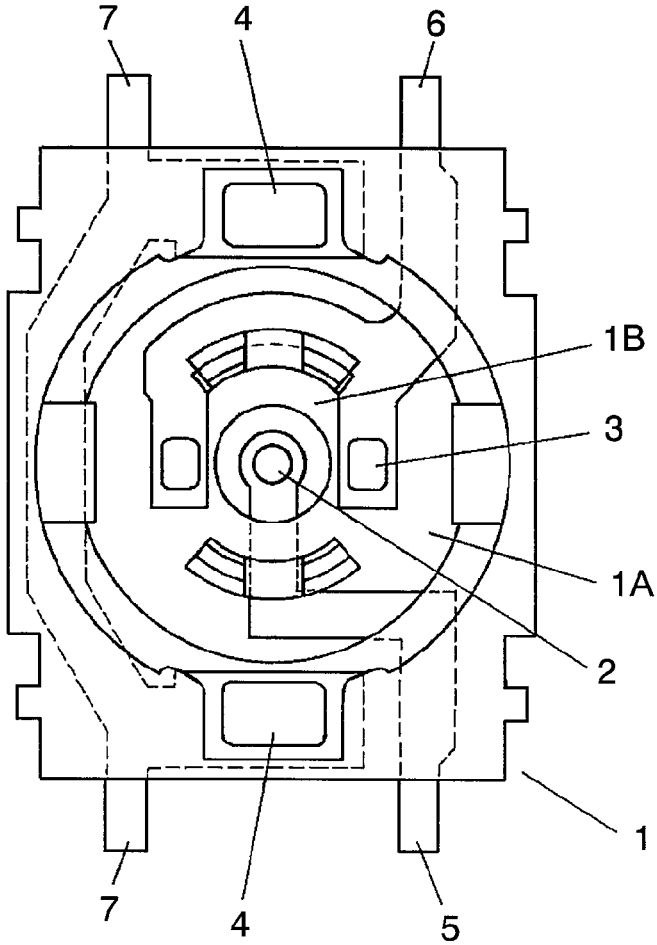
FIG. 11 PRIOR ART
FIG. 11 is a plan view of a switch case in the conventional push switch.
Figure 12:
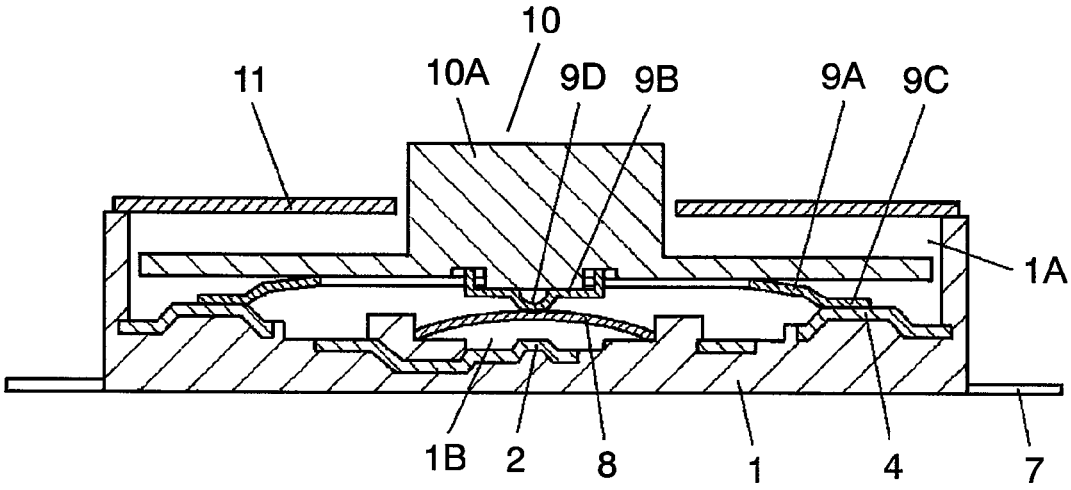
FIG. 12 PRIOR ART
FIG. 12 is a sectional view taken along line 9-9 in FIG. 8, illustrating a first-step operation.
Figure 13:
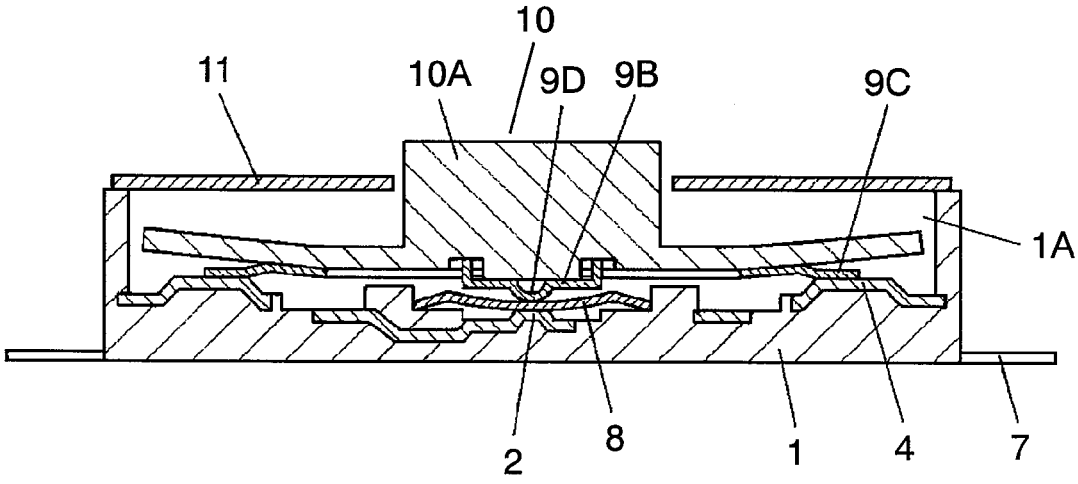
FIG. 13 PRIOR ART
FIG. 13 is a sectional view taken along line 9-9 in FIG. 8, illustrating a second-step operation.
Figure 14:
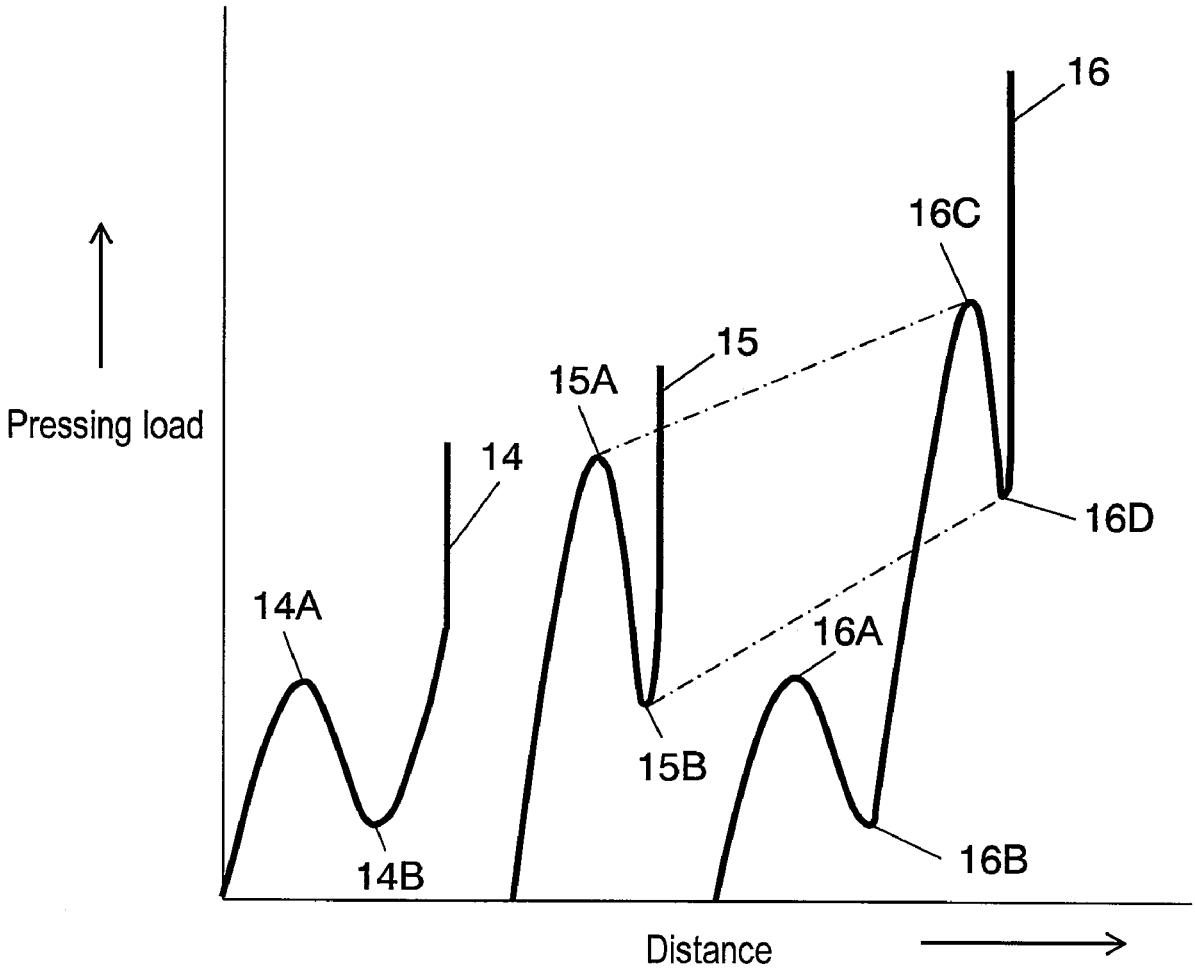
FIG. 14 PRIOR ART
FIG. 14 is a chart of tactile curves of the conventional push switch.

As shown in FIG. 7, first movable contact 50 includes ring portion 50B with central hole 50A, and four legs 50C extending from ring portion 50B. However, no projection is provided on ring portion 50B. Second movable contact 51 has an outer diameter, identical to that of ring portion 50B of first movable contact 50, with no protruding member provided at two opposing points. In addition, no second groove is created on the inner side wall of recess 41A for second movable contact 51. The same reference numerals are given to the components in FIG. 2 to avoid unnecessary duplication. The settings for the operation force of each movable contact are the same as above, and thus a separate description is omitted.

In this structure, ring portion 50B of first movable contact 50 and round second movable contact 51 have the same outer diameter, and their horizontal deviation is limited by the corresponding inner side wall of recess 41A of switch case 41. Accordingly, no projection is provided on ring portion 50B of first movable contact 50, and no protruding member is provided on second movable contact 51. This facilitates processing of first movable contact 50 and second movable contact 51, and similarly facilitates the positioning of second movable contact 51.

As described above, the present invention prevents a detrimental effect of resilient deformation of the first movable contact on tactile feedback produced by resilient deformation of the second movable contact. This achieves the advantageous effect of offering a small and slim push switch with comfortable tactile feedback for both the first step and second step.

What is claimed is:

1. A push switch comprising:

a switch case made of insulating resin, the switch case including a central fixed contact on an inner bottom center of its recess that has an open top, and a peripheral fixed contact disposed at points symmetrical about the central fixed contact, and the switch case having a plurality of first grooves in an inner side wall of the recess;

a first movable contact made of a resilient thin metal plate curved into a dome shape protruding upward, the first movable contact including a ring portion with a central hole disposed over the peripheral fixed contact such that the ring portion opposes the peripheral fixed contact at a distance, and a plurality of legs extending from an outer rim of the ring portion, the legs being provided at positions corresponding to the first grooves; and a second movable contact made of a resilient thin metal plate curved into a dome shape protruding upward, the second movable contact being placed on the ring portion of the first movable contact;

wherein a pressing force for resiliently inverting the second movable contact is set greater than a pressing force for resiliently inverting the first movable contact, and two tactile feedbacks are produced by applying a pressure from a side of the second movable contact.

2. The push switch of claim 1, further comprising a protection sheet covering the open top of the switch case.

3. The push switch of claim 2, wherein the protection sheet is made of an insulating resin film with an adhesive layer, and the protection sheet adheres to and holds the second movable contact.

4. The push switch of claim 2, further comprising a metal cover over the protection sheet, the metal cover having a round central hole.

5. The push switch of claim 4, wherein the metal cover has a grounding protrusion which is in contact with a connecting terminal connected to one of the peripheral fixed contacts.

6. The push switch of claim 1, wherein the switch case further includes a connecting terminal for connecting the central fixed contact and the peripheral fixed contact to outside, respectively.

7. The push switch of claim 1, wherein a load of the second movable contact for self-reverting from a state of being pressed and resiliently inverted is greater than a load of the first movable contact for self-reverting from a state of being pressed and resiliently inverted, when said pressing force is released.

8. The push switch of claim 1, wherein the plurality of legs of the first movable contact and the plurality of first grooves of the switch case are disposed at equiangular positions, respectively, on a same circumference.

9. The push switch of claim 1, wherein horizontal deviation of the ring portion of the first movable contact and the second movable contact is limited by the inner side wall of the recess of the switch case.

10. The push switch of claim 1, wherein the second movable contact has two protruding members extending from an outer rim, and the switch case has a second groove on its inner side wall in a vertical direction at a position corresponding to the protruding members.

11. The push switch of claim 1, wherein the first movable contact has a plurality of projections on a top face of the ring portion, and the second movable contact is placed on these projections.

12. The push switch of claim 11, wherein the plurality of projections are disposed on an inner rim of the ring portion.

* * * * *

UNITED STATES PATENT AND TRADEMARK OFFICE

CERTIFICATE OF CORRECTION

PATENT NO. : 7,429,707 B2
APPLICATION NO. : 11/834987
DATED : September 30, 2008
INVENTOR(S) : Yasunori Yanai et al.

It is certified that error appears in the above-identified patent and that said Letters Patent is hereby corrected as shown below:

Cover Page

After item (65) and before item (51), insert -- (30) Foreign Application Priority Data Aug. 10, 2006 (JP) 2006-218061 --.

Signed and Sealed this

Twentieth Day of January, 2009

JON W. DUDAS
*Director of the United States Patent and Trademark Office*